US008011571B2

(12) United States Patent
Hurrell

(10) Patent No.: US 8,011,571 B2
(45) Date of Patent: Sep. 6, 2011

(54) SELF-SERVICE TERMINAL

(75) Inventor: Nicholas J. Hurrell, Dundee (GB)

(73) Assignee: NCR Corporation, Duluth, GA (US)

( * ) Notice: Subject to any disclaimer, the term of this patent is extended or adjusted under 35 U.S.C. 154(b) by 705 days.

(21) Appl. No.: 12/069,343

(22) Filed: Feb. 8, 2008

(65) Prior Publication Data

US 2009/0200365 A1 Aug. 13, 2009

(51) Int. Cl.
*G07F 19/00* (2006.01)

(52) U.S. Cl. ..... 235/379; 235/375; 235/380; 235/381

(58) Field of Classification Search ..... 235/379, 235/380, 381
See application file for complete search history.

(56) References Cited

U.S. PATENT DOCUMENTS 6,061,666 A * 5/2000 Do et al. ..... 705/43
6,478,221 B1 * 11/2002 Sommerville ..... 235/379
7,000,778 B2 * 2/2006 Omori et al. ..... 209/534
7,175,076 B1 * 2/2007 Block et al. ..... 235/379
2007/0034683 A1 * 2/2007 Eastman et al. ..... 235/379

* cited by examiner

*Primary Examiner* — Daniel A Hess
*Assistant Examiner* — Michael Andler
(74) *Attorney, Agent, or Firm* — Michael Chan; Paul W. Martin

(57) ABSTRACT

A self-service terminal comprises a plurality of devices, each device having a unique device identifier. The terminal also has a fascia including a plurality of apertures, each aperture having a corresponding indicator and being associated with a device in the self-service terminal. The terminal executes a control application for identifying and energizing an indicator corresponding to an aperture to be used by a customer. The terminal also includes a mapping component for allowing an authorized user (i) to display the current mapping of indicators to device identifiers, and (ii) to modify the current mapping to associate an indicator with a different device identifier.

14 Claims, 8 Drawing Sheets

SELF-SERVICE TERMINAL

FIELD OF INVENTION

The present invention relates to a self-service terminal.

BACKGROUND OF INVENTION

One common type of self-service terminal is an automated teller machine (ATM). ATMs have a relatively complex customer interface, typically including a number of different apertures for inputting and outputting media at different stages of a transaction.

To enable customers to identify which aperture they should use at each stage of a transaction, each aperture has an associated media entry and/or exit indicator (MEI) that can be illuminated by a flashing light (typically a row of LEDs).

Throughout a transaction, an ATM selectively energises the appropriate MEI corresponding to the aperture that the customer should use at that particular stage of the transaction. For example, at the beginning of a transaction, the ATM energises an MEI located near the card reader aperture, indicating to the customer that he/she should insert his/her ATM card through that aperture to initiate a transaction.

Some ATM vendors have a default configuration of devices for an ATM, but this configuration can be changed to suit the ATM purchaser's requirements. For example, a default configuration may include one cash dispenser, one motorised card reader, one cheque processing module, one banknote depository, and the like. Some ATM purchasers may prefer to have two cash dispensers but no depository, no cheque processing module, and a dip card reader instead of a motorised card reader.

The MEIs are typically mapped to device identifiers according to the default configuration. This enables software applications to energise the appropriate MEI using the correct device identifier. However, any ATMs that are configured differently to the default configuration may require a re-mapping of the MEIs to device identifiers in the application software; this requires the mapping to be configured and stored in permanent storage on the ATM during ATM build (that is, during production of the ATM) or during ATM commissioning at the installation site.

Re-mapping the MEIs to device identifiers for a custom ATM configuration ensures that the ATM application software can energise the appropriate MEI at each stage of a transaction. If this re-mapping is not performed, then the wrong MEI may be energised at each stage of a transaction. This re-mapping process is inefficient and time-consuming.

It would be desirable to have an improved method of mapping MEIs to device identifiers.

SUMMARY OF INVENTION

Accordingly, the invention generally provides methods, systems, apparatus, and software for efficiently mapping indicators to device identifiers in a self-service terminal.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a self-service terminal comprising: a plurality of devices, each device having a unique device identifier; a fascia including a plurality of apertures, each aperture having a corresponding indicator and being associated with a device in the self-service terminal; a control application for identifying and energising an indicator corresponding to an aperture to be used by a customer; and a mapping component for allowing an authorized user (i) to display the current mapping of indicators to device identifiers, and (ii) to modify the current mapping to associate an indicator with a different device identifier.

The unique device identifier may be a name (such as cash dispenser). The name may be consistent with an international standard, such as the CEN-XFS standard. For example, the CEN-XFS standard uses the name "WFS_SIU_Notedispenser" to identify a cash dispenser. CEN-XFS provides a common API for accessing and manipulating various devices (such as cash dispensers) regardless of the vendor of those devices. For this reason, CEN-XFS provides a list of standard device identifiers. These device identifiers can be used by software executing on the self-service terminal to implement certain functions.

The indicators may be media entry and/or exit (MEI) indicators. Each MEI may relate to a media entry aperture (such as a banknote depository), a media exit aperture (such as a cash dispenser), or an aperture for both media entry and exit (such as a card reader, a currency recycler, or the like).

The control application may control the devices within the self-service terminal and may display a sequence of screens to the customer to guide the customer through a transaction.

The mapping component may be a stand-alone application or a part of the control application.

The mapping component may be operable to enable an authorized user to select a correct association between the indicator being energised and a device identifier.

According to a second aspect there is provided a method of mapping indicators located in the vicinity of corresponding apertures on a self-service terminal to associated device identifiers, the method comprising: providing a current mapping of indicators to device identifiers by selectively energising one of the indicators and presenting information about the device being energised, and modifying the current mapping by enabling an authorized user to select a correct association between an indicator being energised and a device identifier.

The indicators may be: visual, such as LEDs (either continuously powered or pulsed so that they flash), electro-luminescent panels, or the like; audible, such as sound files; or a combination of visual and audible. The indicators may be media entry and/or exit indicators (that is, MEIs).

The step of modifying the current mapping may be implemented by allowing the authorized user either (i) to select a different device identifier for an indicator being energised, or (ii) to instruct the terminal to selectively energise a different indicator, in sequence, until the user indicates that the correct indicator for that device identifier is being energised.

The step of providing a current mapping of indicators to device identifiers by selectively energising one of the indicators and presenting information about the device being energised may be implemented by presenting a screen illustrating a table of device identifiers (for example, cash dispenser, motorised card reader, and the like) and corresponding unique indicator numbers, so that the one-to-one mapping of device identifier to unique indicator number is evident to an authorized user.

According to a third aspect there is provided a computer program containing program instructions for executing all of the steps of the second aspect.

The computer program may be stored in a computer readable medium, such as volatile memory (RAM), non-volatile storage space (hard drive, CD ROM, DVD, a flash drive), or the like.

According to a fourth aspect there is provided a computer program according to the third aspect conveyed on an electrical carrier signal.

These and other aspects will be apparent from the following specific description, given by way of example, with reference to the accompanying drawings.

DETAILED DESCRIPTION

Figure 1:
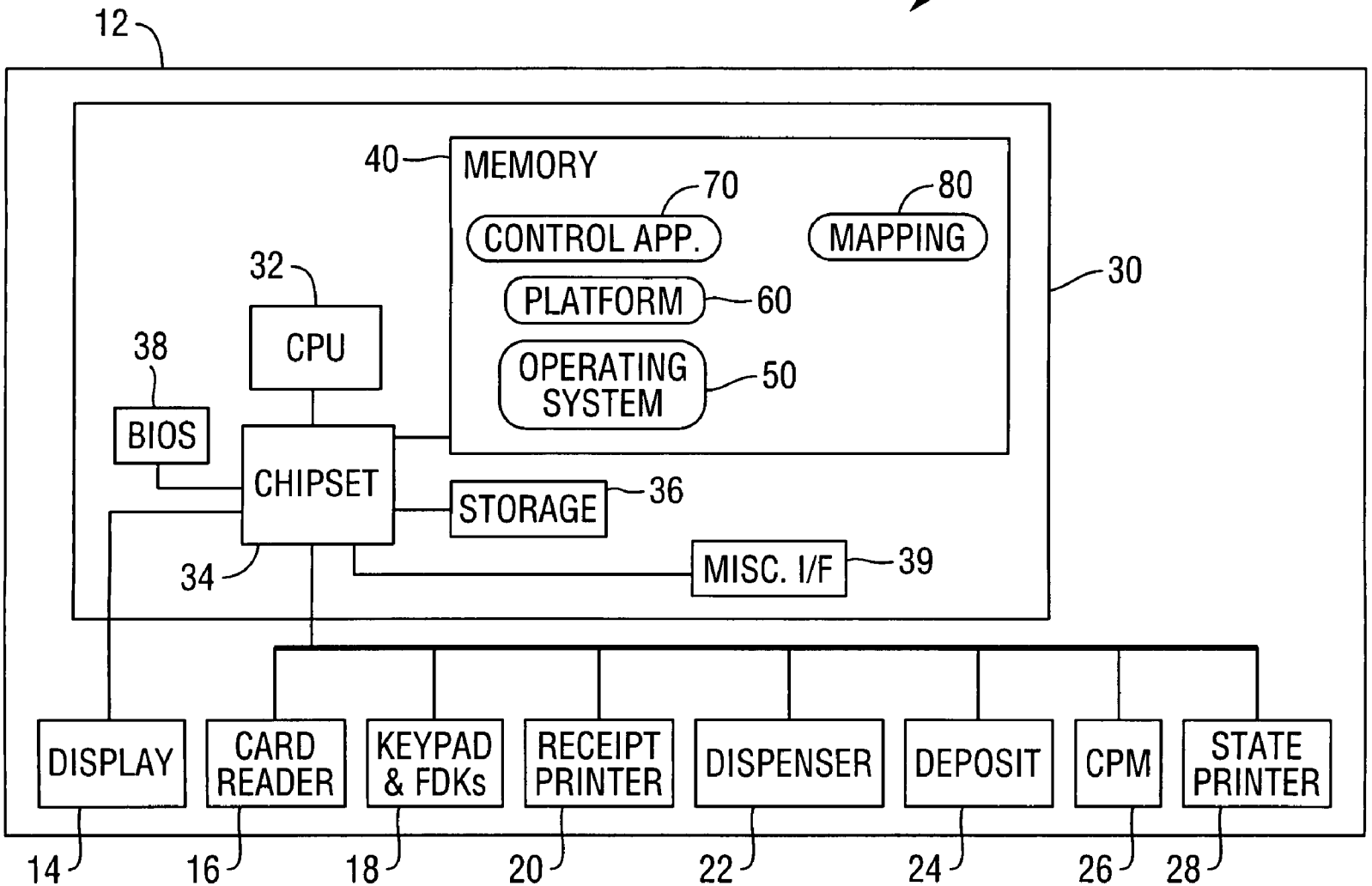
FIG. 1 is a simplified block diagram illustrating the architecture of a self-service terminal according to one embodiment of the present invention.

Reference is first made to FIG. 1, which is a simplified block diagram of a self-service terminal 10, in the form of an automated teller machine (ATM), according to one embodiment of the present invention.

The ATM 10 comprises a chassis 12 in which a plurality of customer interfacing devices are mounted. These customer interfacing devices include: a display 14, a motorised card reader 16, an encrypting keypad 18 (including function defined keys (FDKS) aligned on either side of the display 14, a receipt printer 20, a cash dispenser 22, a cash depository 24, a cheque processing module (CPM) 26, and a statement printer 28.

The ATM 10 includes other devices for performing internal functions (such as a network card, a journal printer, and the like). These devices are not illustrated for simplicity.

The ATM 10 also includes a PC core 30 comprising a processor 32, a chipset 34 (including a graphics and memory controller hub and an input/output controller hub), storage 36 (in the form of a hard drive), non-volatile memory 38 storing a BIOS and configuration information, a miscellaneous interface board 39, and volatile memory 40 (in the form of DRAM).

Figure 2:
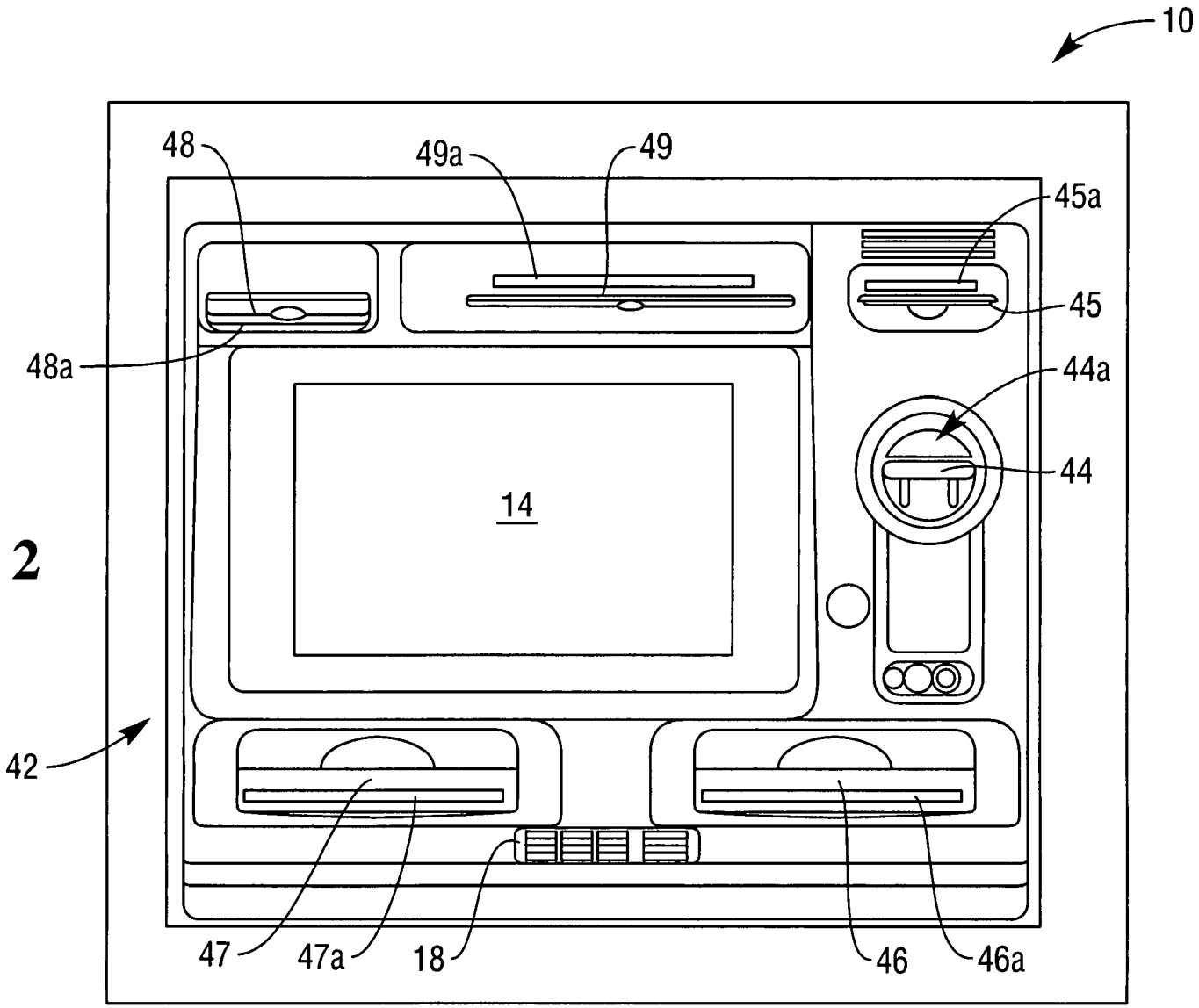
FIG. 2 is a pictorial front view of part (the customer interface) of the self-service terminal of FIG. 1.

Reference will now also be made to FIG. 2, which is a pictorial front view of a customer interface 42 of the ATM 10. The customer interface 42 includes apertures (also called slots) aligning with devices within the ATM 10. These apertures include a card reader aperture 44, a receipt printer aperture 45, a dispenser aperture 46, a cash depository aperture 47, a CPM aperture 48, and a statement printer aperture 49. Each of these apertures has a corresponding indicator (an MEI) aligned with the associated aperture. The MEIs are labelled in FIG. 2 with the number of the corresponding aperture but with the subscript "a", for example, receipt printer MEI 45*a*, cash depository MEI 47*a*, and the like.

The customer interface devices in the ATM 10 have predefined device identifiers according to the CEN-XFS standard, as shown below in Table 1. These device identifiers are mapped to a physical connection for an MEI associated with a device. The physical connection is provided on the miscellaneous interface board 39.

Table 1 illustrates the default mapping used in this embodiment. For example, physical MEI connection number one is used for a motorised card reader 16, number four would be used for a dip card reader if it was installed on the ATM 10; number five is used for the cash dispenser 22, and so on. The configuration information stored in the non-volatile memory 38 is very similar to the mapping shown in Table 1, but the configuration information does not include mappings for devices that are not present in the ATM 10 (such as an envelope depository).

The identifiers shown in Table 1 can be used by ATM applications to illuminate the appropriate MEI at each stage of a transaction, for example, at the start of a transaction, the card reader MEI 44*a* is illuminated. The MEIs shown in FIG. 2 are highly visible when illuminated but difficult to see when not illuminated.

TABLE 1

| Physical MEI Number | CEN XFS Name Default Mapping (identifier) |
|---|---|
| 1 | WFS_SIU_Cardunit |
| 2 | WFS_SIU_Envelopedepository |
| | WFS_SIU_Envelopedispenser |
| 3 | WFS_SIU_Documentprinter |
| | WFS_SIU_Passookprinter |
| 4 | WFS_SIU_Cardunit |
| 5 | WFS_SIU_Notedispenser |
| 6 | WFS_SIU_Chequeunit |
| 7 | WFS_SIU_Receiptprinter |
| 8 | WFS_SIU_Coindispenser |
| 9 | WFS_SIU_Coinacceptor |
| 10 | WFS_SIU_Envelopedispenser |
| 11 | WFS_SIU_Passbookprinter |
| 12 | WFS_SIU_Secondnotedispenser |
| 13 | WFS_SIU_Billacceptor |
| 14 | WFS_SIU_Scanner |
| 15 | WFS_SIU_Pinpad |
| 16 | Reserved for future use |

Table 1 illustrates the default mapping of physical MEI connections to device identifiers for the ATM 10.

Initialisation of the ATM

When the ATM 10 is booted up, the microprocessor 32 accesses the hard drive 36 and loads the volatile memory 40 with software components, as will now be described.

The microprocessor 32 loads an operating system kernel 50 into the main memory 40 and a plurality of device drivers for interfacing with standard computing devices such as the hard drive 36, the display 14, a serial port, and the like. In this embodiment, the operating system is a Windows XP (trade mark) operating system, available from Microsoft Corporation (trade mark).

The microprocessor 32 also loads a run-time platform 60 into the volatile memory 40. In this embodiment, the runtime platform 60 is a set of APTRA (trade mark) XFS components, available from NCR Corporation, 1700 S. Patterson Blvd., Dayton, Ohio 45479, U.S.A. The run-time platform 60 provides a range of programming facilities specific to self-service terminal devices and services.

The run-time platform 60 includes a plurality of self-service device drivers that interface with self-service specific devices (such as the card reader 16, the receipt printer 20, and the like). The run-time platform 60 also includes a feature manager executable file containing feature managers and other components for adding self-service functionality (for example, supporting XFS-compliant commands) to the devices mounted in the ATM 10.

The microprocessor 32 also loads a control application (CA) 70 into the main memory 40. The CA 70 provides transaction processing and management functions for users of the ATM 10. Users of the ATM 10 include customers (who execute transactions), ATM technicians (who service the ATM), and replenishers (who replenish or empty contents of devices in the ATM).

When the ATM 10 is to be configured (for example, during installation or immediately post-production) then an authorized user launches a mapping application (the mapping component) 80 resident on the ATM 10.

Figure 3:
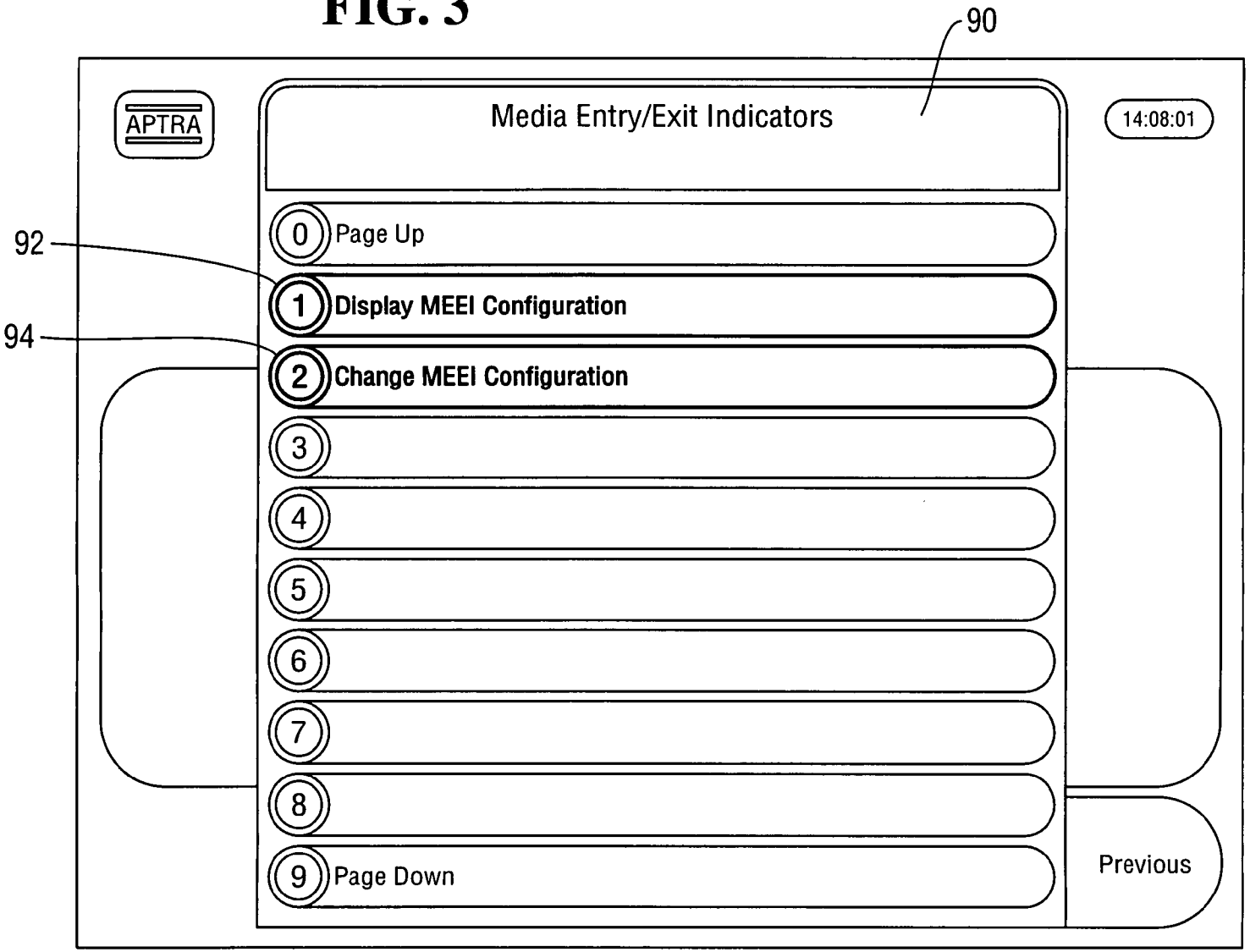
FIG. 3 illustrates a screen presented to an authorized user on another part (the display) of the self-service terminal of FIG. 1 and providing the user with two options.

Reference will now be made to FIG. 3, which illustrates a screen 90 presented by the mapping application 80 to an authorized user (such as an ATM technician) on the display 14 of the ATM 10. The screen 90 provides the user with two options: (i) display current MEI configuration (illustrated by arrow 92), and (ii) modify the current mapping to associate an MEI with a different device identifier (illustrated by arrow 94).

Display Current Mapping

If the user selects the first option (that is, to display the current MEI configuration), then the mapping application 80 reads configuration information for the MEIs from the non-volatile memory 38. This configuration information stores the current mapping of device identifiers to physical connections.

Figure 4:
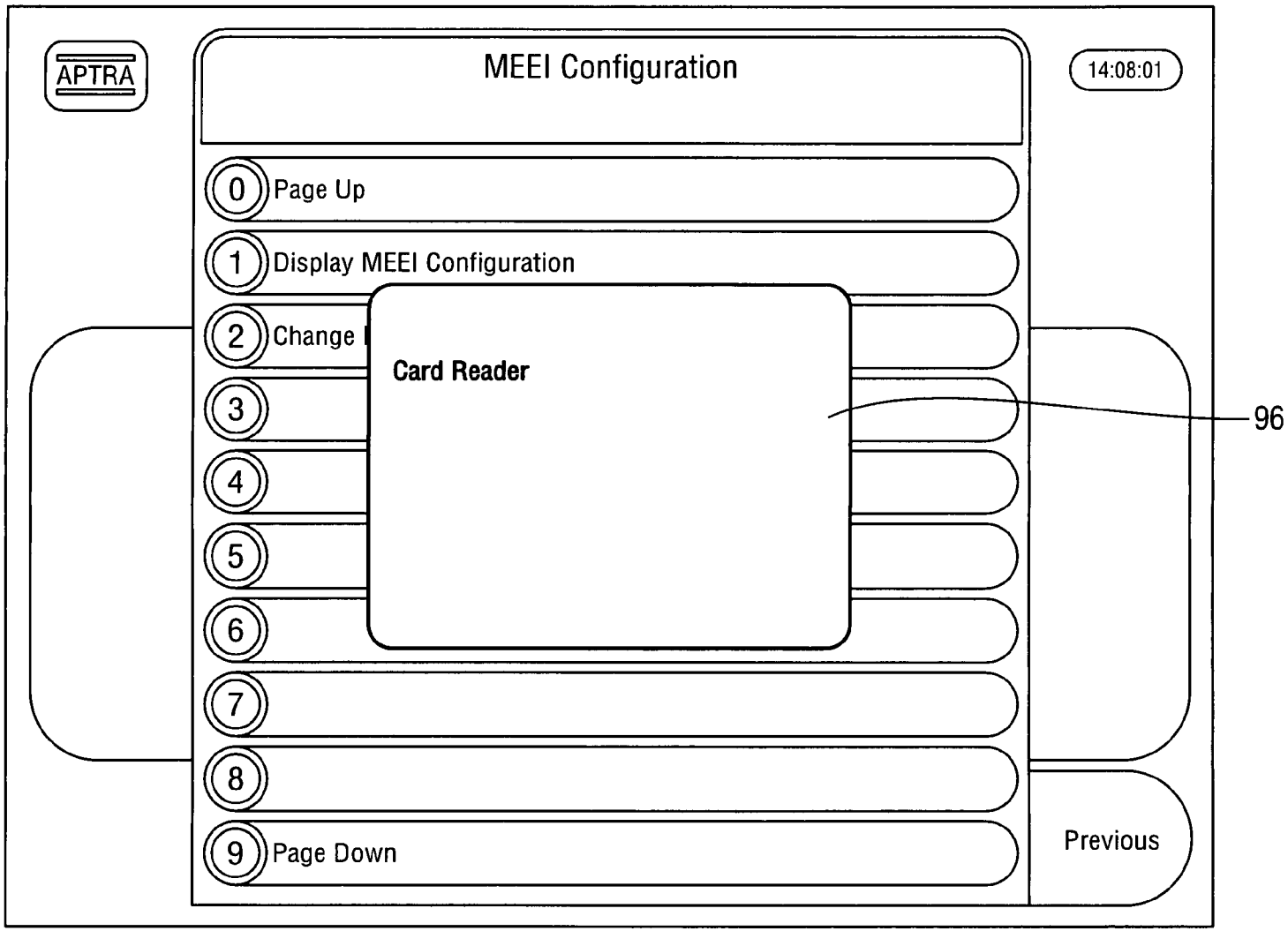
FIG. 4 is a pictorial view of a screen presented to the user when the first option (display MEI mapping) has been selected by the user.
Figure 5:
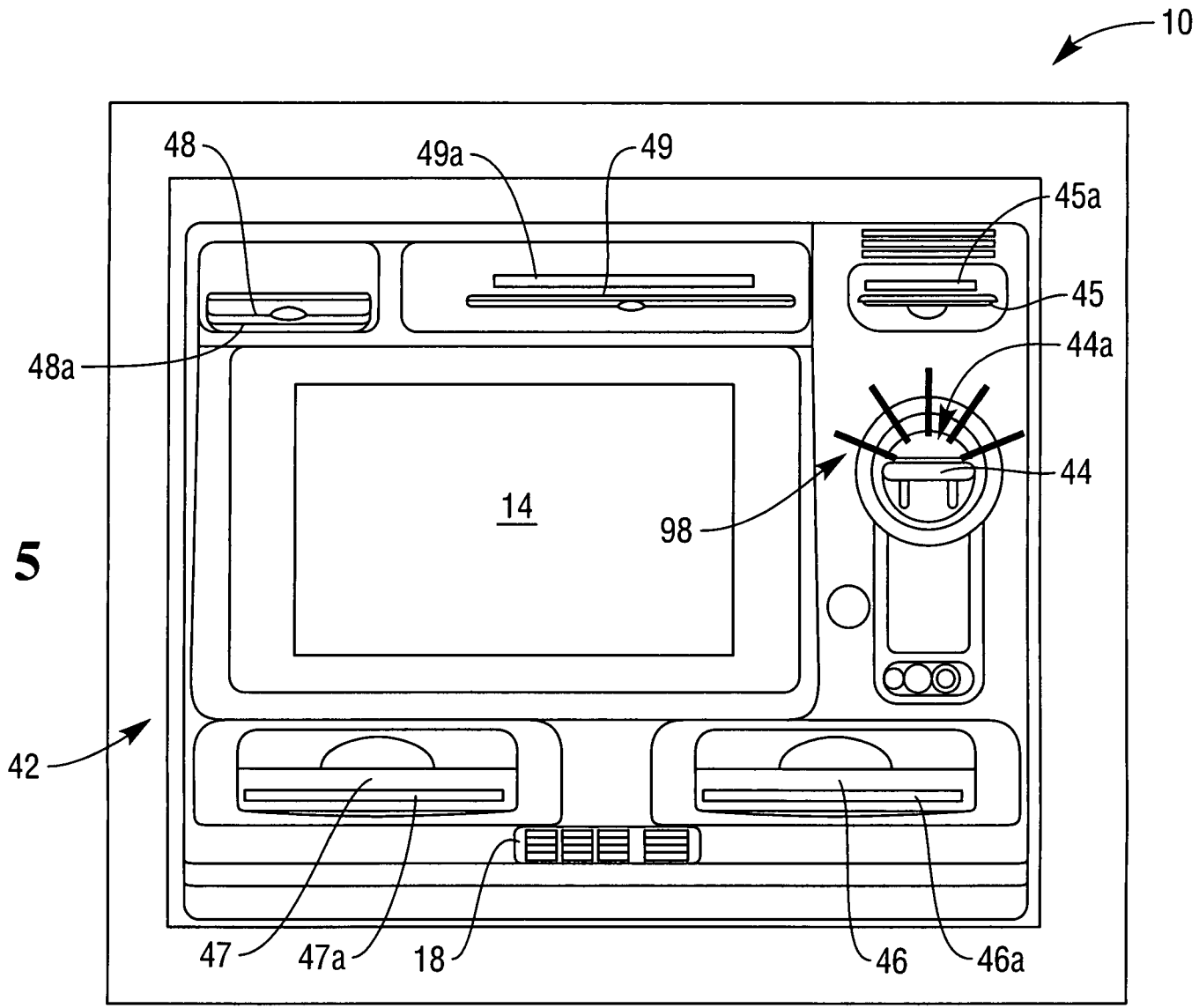
FIG. 5 is a pictorial front view of the customer interface of FIG. 2 when an indicator (MEI) is being energised.

The mapping application 80 reads the first entry of the configuration information. In Table 1, the first entry is the motorised card reader 16. The mapping application 80 then displays a pane 96 (FIG. 4) on the display 14 to inform the user that the card reader MEI 44*a* is being activated, and then activates the card reader MEI 44*a* for a predefined time period (in this example three seconds), as illustrated in FIG. 5 by fan-shaped lines 98. This enables the user to check which MEI is currently mapped to the card reader device 16.

The mapping application 80 then reads the next entry (in Table 1 it is an envelope depository, but since there is no envelope depository installed on ATM 10, the next entry that is present is the document printer—which is the statement printer 28). The mapping application 80 displays another pane (not shown) on the display 14 to inform the user that the statement printer MEI 49*a* is being activated, and then activates the statement printer MEI 49*a* for a predefined time period (in this example three seconds). This enables the user to check which MEI is currently mapped to the statement printer device 28.

The mapping application 80 continues to cycle through the configuration information until all of the MEIs have been illuminated in turn. This allows the user to ascertain if the MEIs are correctly mapped to the devices/apertures. Since a device is permanently associated with an aperture, the mapping can be considered as between (i) the MEI and the aperture, or (ii) as between the MEI and the device that interfaces through that aperture.

If all of the MEIs are correctly mapped to their corresponding apertures, then the user can close the mapping application 80 because the ATM 10 is correctly configured.

If one or more of the MEIs are not correctly mapped to their corresponding apertures, then the user can select the second option 94 (FIG. 3) to modify the current mapping to associate an MEI with a different device identifier.

Modify Current Mapping

Figure 6:
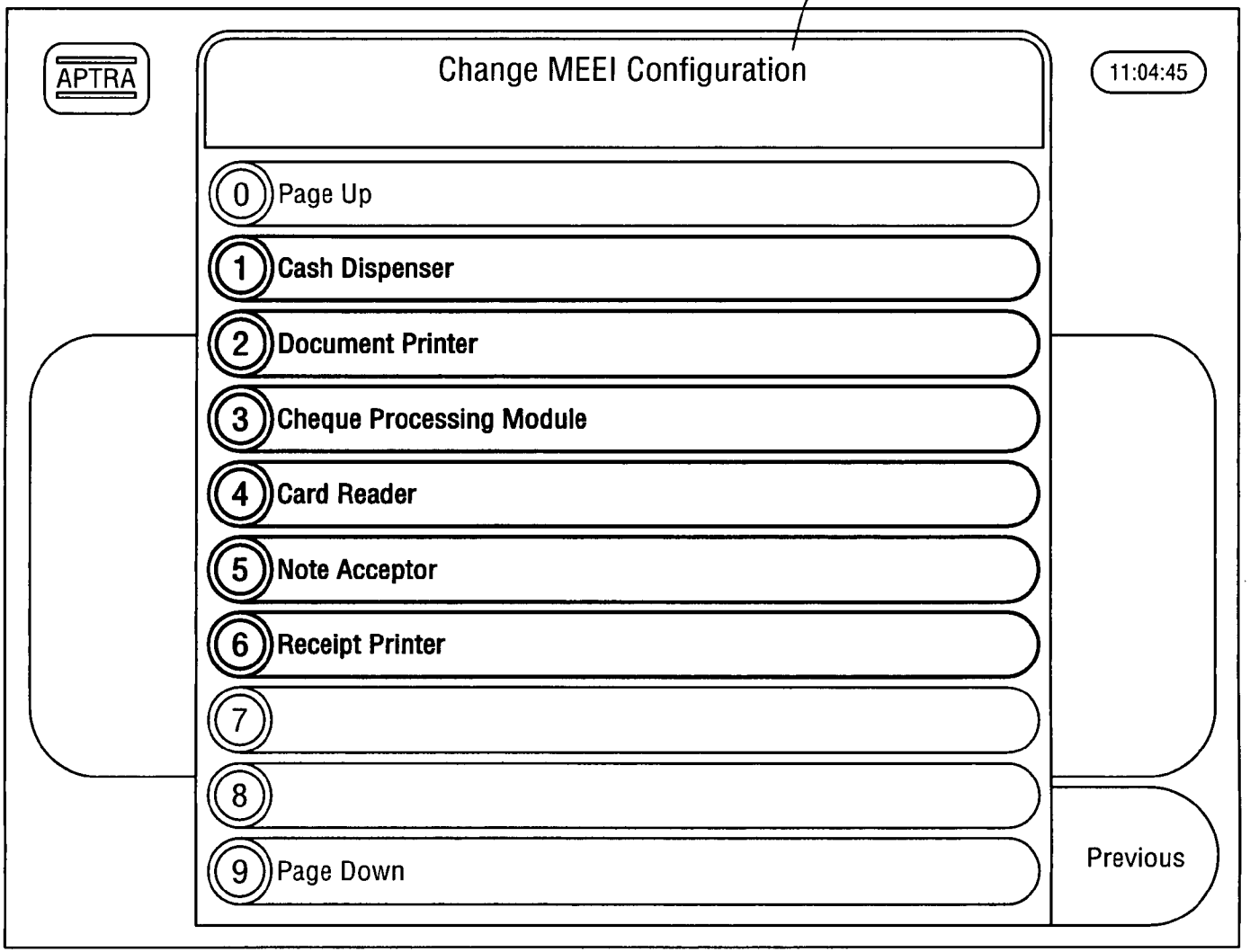
FIG. 6 illustrates a screen presented to the user when the second option (change MEI mapping) has been selected by the user.
Figure 7:
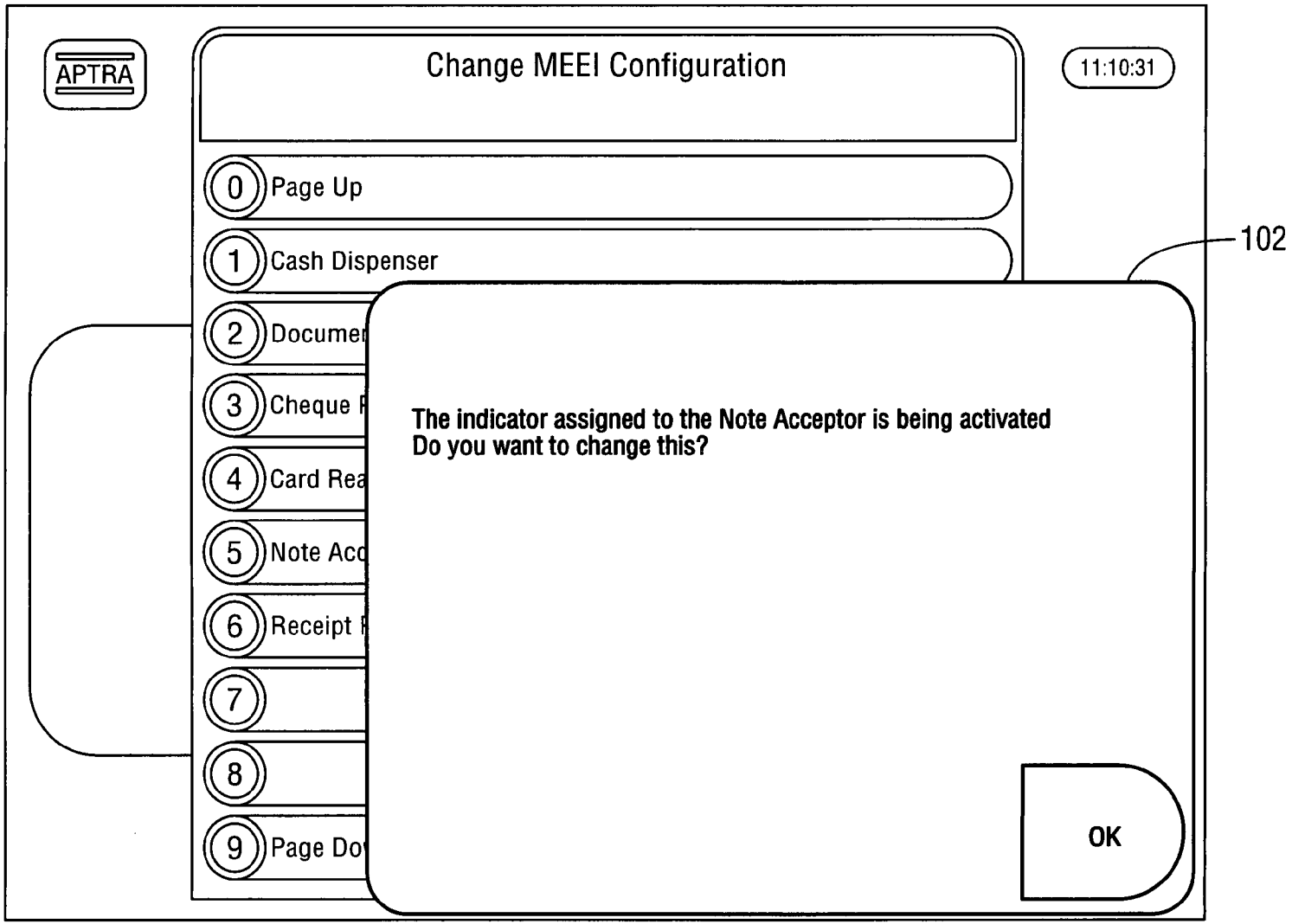
FIG. 7 illustrates a screen for informing the user that an MEI for a specific device is being energised.
Figure 8:
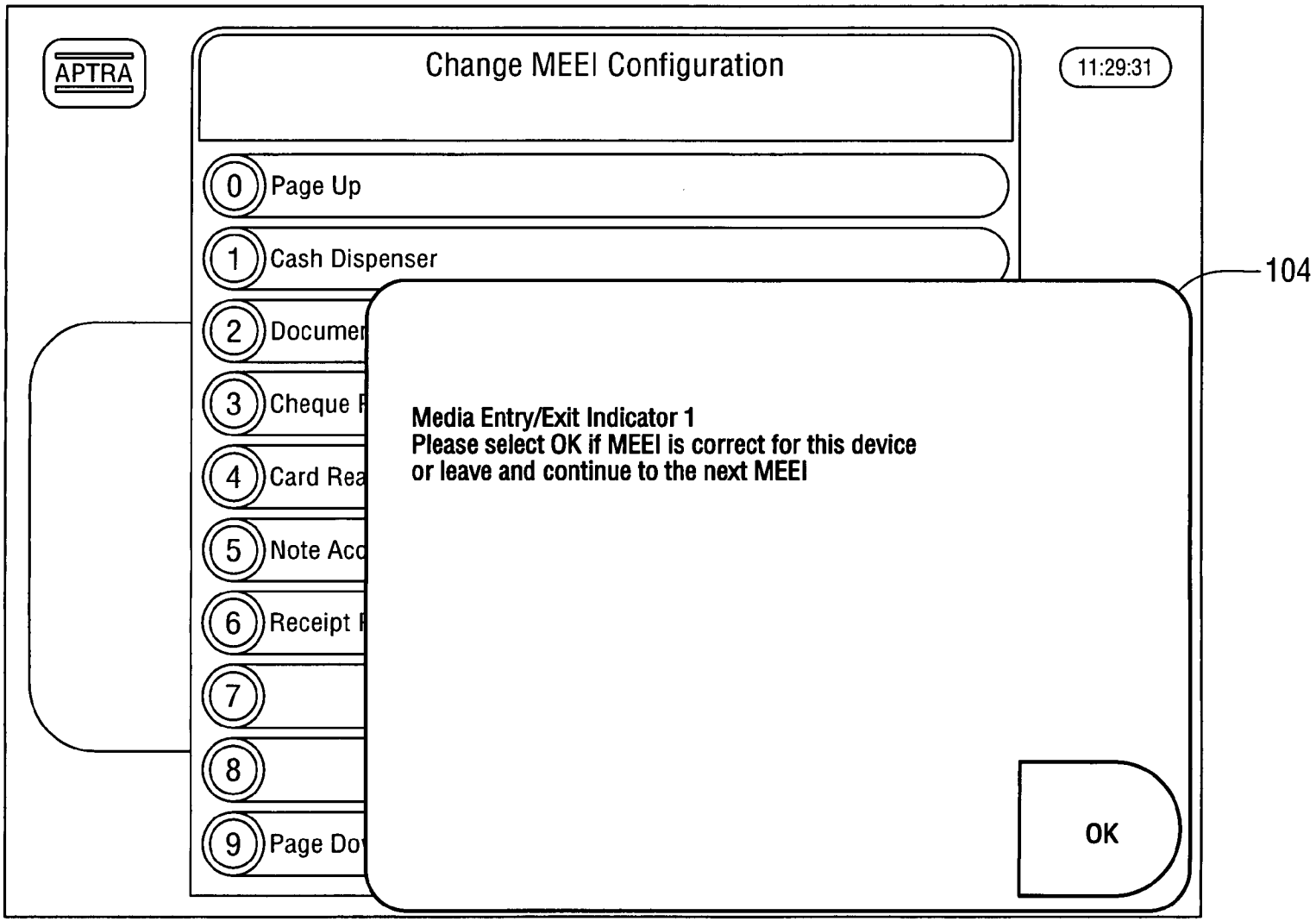
FIG. 8 illustrates a screen for requesting the user to identify when the MEI for a specific device is being energised.

When the user selects option two 94 (FIG. 3), then he/she is presented with an MEI configuration screen 100, as shown in FIG. 6, which lists the devices present that have an associated MEI.

The user can then select any of these devices by pressing a number corresponding to the device name, or by pressing the display 14 if the display 14 includes a touch sensitive panel.

In this example, the user selects the note acceptor (another name for the cash depository device 24), which has the CEN-XFS identifier of "WFS_SIU_Billacceptor". The note acceptor is listed as number five on the MEI configuration screen 100.

The mapping application 80 reads the configuration information for the MEIs from the non-volatile memory 38 to ascertain which physical connection corresponds to this device identifier ("WFS_SIU_Billacceptor"). In this example, the physical connection corresponding to the cash depository device 24 is the default mapping, which is connection five (see Table 1 above).

The mapping application 80 then activates the MEI coupled to physical connection five, which is the cash depository (note acceptor) aperture 47*a*. Simultaneously with activating the MEI coupled to physical connection five, the mapping application 80 informs the user via a screen 102 that the MEI being activated is that for the note acceptor.

Screen 102 also provides the user with an option of changing this mapping for the note acceptor if it is not correct (by pressing ENTER on the keypad 18), or returning to the MEI configuration screen 100 if the mapping for the note acceptor is correct (by pressing CANCEL on the keypad 18).

The mapping application 80 provides these options (change mapping or return to configuration screen 100) for each device, so that the user can change the mapping for each device on a device by device basis.

For example, if the card reader MEI is actually being activated instead of the note acceptor MEI, then the user would select ENTER to change the mapping. When the user selects ENTER, the mapping application 80 then cycles through all of the MEIs in turn, activating each MEI for a predefined period (such as three seconds) and providing a screen 104 on the display (i) to inform the user about which physical connection is currently being activated, and (ii) to request the user to select ENTER if the correct MEI is currently being activated.

When the user selects ENTER at screen 104, then the mapping application 80 remaps that device to the MEI that was activated when the user pressed ENTER.

The mapping application 80 then selects the next device and presents another screen similar to screen 102 informing the user about the name of the device, activating the corresponding physical connection, and requesting the user to press ENTER on the keypad 18 if the mapping is not correct.

The mapping application 80 knows which devices have been mapped by the user since option two 94 (modify mapping) was selected, so the mapping application 80 cycles through the MEIs that have not yet been mapped before cycling through the MEIs that have been mapped.

Once all of the MEIs have been correctly mapped, the user exits the mapping application 80, and the mapping application 80 stores the new mapping in the configuration information in the non-volatile memory 38. The MEIs are then correctly mapped to the devices in the ATM 10.

Various modifications may be made to the above described embodiment within the scope of the invention, for example, the mapping application may be provided as part of the control application or as part of the platform.

In other embodiments, a self-service terminal other than an ATM may be used, for example, a self-checkout and/or check-in terminal.

In other embodiments, the terminal may use a touchscreen to allow the user to select an option by touching that option.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

What is claimed is:

1. A self-service terminal comprising:

a plurality of devices, each device having a unique device identifier;

a fascia having a plurality of apertures, each aperture being associated with a device of the plurality of devices and being aligned with the device so that a customer can use the device through the aperture during a self-service transaction;

a plurality of energisable indicators, each indicator being associated with an aperture of the plurality of apertures and thereby being associated with a device and thereby being associated with a device identifier so as to map the indicator to a device identifier;

a control application for identifying and energising an indicator corresponding to an aperture to be used by a customer during a self-service transaction; and a mapping component for allowing an authorized user (i) to display the current mapping of indicators to device identifiers, and (ii) to modify the current mapping to associate an indicator with a different device identifier.

2. A terminal according to claim 1, wherein each indicator is a media entry and/or exit indicator.

3. A terminal according to claim 1, wherein the mapping component is operable to enable an authorized user to select a correct association between an indicator being energised and a device identifier.

4. A terminal according to claim 1, further comprising a cash dispenser.

5. A method of mapping energisable indicators located in the vicinity of corresponding apertures on a fascia of a self-service terminal to device identifiers associated with devices of the self-service terminal, the method comprising:

displaying a current mapping of indicators to device identifiers;

selectively energising one of the indicators;

presenting first information about a device being associated with the indicator being energised to allow an authorized user to ascertain if the energised indicator is correctly mapped to the associated device;

if the indicator being energised is incorrectly mapped to the associated device, presenting second information to allow the authorized user to select a correct association between the energised indicator and a device identifier; and modifying the current mapping in response to the authorized user selecting a correct association between the indicator being energised and a device identifier.

6. A method according to claim 5, wherein the indicators are visual.

7. A method according to claim 5, wherein modifying the current mapping is implemented by allowing the authorized user to select a different device identifier for the indicator being energised.

8. A method according to claim 5, wherein modifying the current mapping is implemented by allowing the authorized user to instruct the terminal to selectively energise a different indicator, in sequence, until the user indicates that the correct indicator for that device identifier is being energised.

9. A method according to claim 5, wherein presenting first information about a device being associated with the indicator being energised is implemented by presenting a screen illustrating a table of device identifiers and corresponding unique indicator numbers, so that a one-to-one mapping of device identifier to unique indicator number is evident to the authorized user.

10. A computer program containing program instructions for executing all of the steps of claim 5.

11. A computer program according to claim 10, wherein the computer program is conveyed on an electrical carrier signal.

12. An automated teller machine (ATM) comprising:

a plurality of ATM customer interface devices including a cash dispenser, each device having a unique device identifier;

a fascia having a plurality of apertures, each aperture being associated with an ATM customer interface device of the plurality of ATM customer interface devices and being aligned with the device so that an ATM customer can use the device through the aperture during an ATM transaction;

a plurality of energisable indicators disposed on the fascia, each indicator being associated with an aperture of the plurality of apertures and thereby being associated with an ATM customer interface device and thereby being associated with a device identifier so as to map the indicator to a device identifier;

an ATM control application for identifying and energising an indicator corresponding to an aperture to be used by an ATM customer during an ATM transaction; and a mapping component for allowing an ATM technician who is other than an ATM customer to (i) display the current mapping of indicators to device identifiers, and (ii) modify the current mapping to associate an indicator with a different device identifier.

13. An ATM according to claim 12, wherein each indicator comprises a number of energisable light emitting diodes (LEDs) disposed on the fascia and for, when energised, indicating to an ATM customer to use the ATM customer interface device associated with the aperture corresponding to the energised LEDs.

14. An ATM according to claim 12, wherein the mapping component is operable to enable an ATM technician who is other than an ATM customer to select a correct association between an indicator being energised and a device identifier.

* * * * *